US005735334A

United States Patent [19]

Sutton et al.

[11] Patent Number: 5,735,334

[45] Date of Patent: Apr. 7, 1998

[54] CASTING OF LIGHT METAL ALLOYS

[75] Inventors: Thomas Leonard Sutton, Preston; John Campbell, Worcester; Michael Joseph Flynn, Poswick; Gary McBain, Cleveleys, all of United Kingdom

[73] Assignee: Alloy Technologies Limited, England

[21] Appl. No.: 244,352

[22] PCT Filed: Dec. 7, 1992

[86] PCT No.: PCT/GB92/02268

§ 371 Date: Mar. 21, 1995

§ 102(e) Date: Mar. 21, 1995

[87] PCT Pub. No.: WO93/11892

PCT Pub. Date: Jun. 24, 1993

[30] Foreign Application Priority Data

Dec. 7, 1991 [GB] United Kingdom ..... 9126046
Jul. 28, 1992 [GB] United Kingdom ..... 9216069

[51] Int. Cl.[6] ..... B22C 11/10; B22C 47/02

[52] U.S. Cl. ..... 164/130; 164/136; 164/167; 164/323; 164/337

[58] Field of Search ..... 164/322, 323, 164/324, 133, 167, 337, 134, 135, 136, 335, 129, 130

[56] References Cited

U.S. PATENT DOCUMENTS

| | | | |
|---|---|---|---|
| 2,804,664 | 9/1957 | Brennam | 164/323 |
| 2,873,491 | 2/1959 | Brennan | 164/323 |
| 3,191,292 | 6/1965 | Strom | 164/133 |
| 3,265,348 | 8/1966 | Sylvester | 164/133 |
| 3,580,324 | 5/1971 | Copley et al. | 164/127 |

(List continued on next page.)

FOREIGN PATENT DOCUMENTS

| | | | |
|---|---|---|---|
| 5947054 | 3/1984 | Japan . | |
| 61-189861 | 8/1986 | Japan | 164/337 |
| 848604 | 9/1960 | United Kingdom . | |
| 1320606 | 7/1971 | United Kingdom . | |
| 1 357 410 | 6/1974 | United Kingdom . | |
| 0 057 937 | 4/1981 | United Kingdom . | |
| WO 90/15468 | 12/1990 | WIPO . | |

OTHER PUBLICATIONS

A. W. Jones, "Electromagnetic Pumps in Foundry and for use in the Metal Industry," Aluminium Technology '86, Appendix 3, pp. 763–770 (1986).
Abstract of German Patent 3618059 Dec. 3, 1987.
Abstract of United Kingdom 2183517A Jun. 10, 1987.
Abstract of United Kingdom 2159445A Dec. 4, 1985.
Abstract of United Kingdom 2050220A Jan. 7, 1981.
Abstract of United Kingdom 1440209 Sep. 17, 1973.
Abstract of United Kingdom 1397821 Apr. 18, 1972.
Abstract of United Kingdom 1397822 Apr. 18, 1972.
Abstract of United Kingdom 1377836 Oct. 17, 1972.

(List continued on next page.)

*Primary Examiner*—J. Reed Batten, Jr.
*Attorney, Agent, or Firm*—Pravel, Hewitt, Kimball & Krieger

[57] ABSTRACT

Light alloy metal products are cast by introducing the molten metal into a sand mold having a vertical parting line, characterized in that the mold is bottom filled.

20 Claims, 6 Drawing Sheets

U.S. PATENT DOCUMENTS

| | | | |
|---|---|---|---|
| 3,684,004 | 8/1972 | Germain et al. . | |
| 3,799,238 | 3/1974 | Bruderer et al. . | |
| 3,863,706 | 2/1975 | Chandley et al. . | |
| 3,900,064 | 8/1975 | Chandley et al. . | |
| 4,006,396 | 8/1986 | Chandley et al. | 164/255 |
| 4,199,087 | 4/1980 | Golas et al. | 164/133 |
| 4,532,976 | 8/1985 | Chandley . | |
| 4,562,943 | 1/1986 | Freytag et al. . | |
| 4,606,396 | 8/1986 | Chandley et al. . | |
| 4,616,689 | 10/1986 | Denis . | |
| 4,714,102 | 12/1987 | Koya | 164/133 |
| 4,733,714 | 3/1988 | Smith . | |
| 4,745,962 | 5/1988 | Mercer et al. . | |
| 4,749,019 | 6/1988 | Sorrell et al. . | |
| 4,757,857 | 7/1988 | Henkel . | |
| 5,014,768 | 5/1991 | Waters et al. . | |
| 5,029,630 | 7/1991 | Voss . | |

OTHER PUBLICATIONS

Abstract of United Kingdom 1336714 Nov. 16, 1970.

Abstract of United Kingdom 1199394 Feb. 7, 1968.

Abstract of United Kingdom 1210208 Apr. 11, 1969.

Abstract of United Kingdom 2160133A Dec. 18, 1995.

Abstract of Germany 3247317 Jun. 28, 1984.

Abstract of EP 144727 Jun. 19, 1985.

Abstract of EP 98405 Jan. 18, 1984.

Abstract of EP 452654 Oct. 23, 1991.

Abstract of EP 372945 Jun. 13, 1990.

Abstract of EP 174855 Mar. 19, 1986.

J. Czikel, R. Gloggnitzer and F. Schwartz, "Theorie Und Praxis Des Gravicast–Giesssystems," 45th International Foundry Congress, Budapest '78, pp. 1–11.

CASTING OF LIGHT METAL ALLOYS

BACKGROUND OF THE INVENTION

1. Field of the Invention

This invention relates to the casting of light metal alloys for example of aluminium or magnesium.

2. Description of Prior Art

Existing casting techniques for the production of light metal alloy castings are unsatisfactory because of low production rates and casting defects resulting from turbulence during pouring of the molten metal. In order to avoid the filling problems when casting light alloys the low pressure die casting process uses a liquid metal reservoir which is pressurised to displace the metal up a riser tube into the metal die. Although this process results in an improvement in the casting quality it has two main disadvantages: firstly, poor control of upwards displacement of the metal sometimes results in the turbulence which the process is intended to avoid; secondly, production rates are low because of the long cycle time (typically 4–6 minutes) of the metal die.

In the Cosworth process as described for example in UK Patent No. 2187984 sand moulds are filled by a low pressure technique and improved control over filling is achieved by the use of an electromagnetic pump having no moving parts which is effectively a linear motor. The sand mould has a horizontal parting line to facilitate bottom feeding. The moulds are made from chemically bonded sand at a rate dependent upon the time taken by the chemical reactions required to bind the sand. Although the cycle time is considerably reduced compared to low pressure die casting a casting may nevertheless take some 40 to 60 seconds to produce.

Ferrous casting processes using sequentially produced green sand moulds are known to have a shorter cycle time but have been disregarded for the casting of light metal alloys because of the filling problems described above. For example U.K. Patent No. 848604 by Disa describes the commercially well-known ferrous metal casting apparatus in which green sand mould halves are continually formed in a compaction zone and arranged one behind the other to provide a succession of moulds with vertical parting lines. The moulds are moved under a top filling station from which molten ferrous metal is gravity poured into the successive mould cavities. In a modification of the Disa process described in U.K. Patent No. 1357410 by Gravicast Patentverwertungsgesellschaft m.b.H., which as far as the applicants are aware has had no commercial application, the sand moulds are bottom filled but the velocity and pressure of the in-flowing melt cannot be controlled to the extent required for casting of light metal alloys.

SUMMARY OF THE INVENTION

It is an object of the present invention to further improve the casting of light metal alloys, in particular by increasing the rate at which castings may be made.

According to one aspect of the present invention there is provided a method of casting light alloy metal products, comprising introducing the molten metal into a sand mould having a vertical parting line, by bottom filling in a manner permitting control of flow velocity and pressure.

Preferably, bottom filling of the mould involves introducing liquid metal into the mould at a mould inlet (which may be on a side or bottom wall of the mould) and below the level of the mould cavity, introducing the metal into the mould cavity by a cavity inlet at or closely adjacent to the bottom of the mould cavity, and interconnecting the mould inlet with the cavity inlet by a passageway which preferably has a positive gradient throughout its length so that the metal always travels against gravity.

By using a vertically parting sand mould use can be made of high speed green sand moulding techniques in which sand is bonded by a clay/water binder capable of forming an instant bond on the application of pressure, thereby substantially reducing cycle times (typically to 10–15 seconds). By bottom filling of the sand mould, preferably using an electromagnetic pump for pumping molten metal from an unpressurised reservoir below the level of the mould, filling problems are reduced and casting quality is improved.

Preferably, a succession of sand moulds is produced by forming identical half-moulds each having a front face defining the rear part of the mould cavity of one mould and a rear face defining the front part of the mould cavity of the next following mould.

According to a second aspect of the present invention there is provided casting apparatus comprising means for making a sand mould with a vertical parting line and filling means for filling the mould with molten metal, wherein the filling means is adapted to bottom fill the mould in a manner permitting control of flow velocity and pressure.

Preferably, the mould making means is adapted to produce a succession of said moulds by forming identical half-moulds each having a front face defining the rear part of the mould cavity of one mould and a rear face defining the front part of the mould cavity of the next following mould.

According to a third aspect of the present invention there is provided a sealing device for an inlet of a sand mould, comprising a filling opening and a chill plate having a sealing face for sliding contact with an inlet side of the mould between a filling position in which the filling opening registers with the mould inlet and a sealing position in which the inlet is closed by the sealing face for a period of time sufficient to permit solidification of the metal in the inlet.

Preferably, the chill plate filling opening has a refractory lining.

The chill plate is preferably adapted for internal circulation of coolant to lower the temperature of the sealing face.

Preferably, the leading end of the chill plate has a cutting or forming edge for making a smooth contact face in the inlet side of the mould during said sliding movement.

The chill plate may be fixed to a filling nozzle for introducing molten metal into the mould.

Means is preferably provided for pressing the chill plate against the inlet side of the mould at an adjustable pressure.

The sealing device may be incorporated in casting apparatus as claimed in the first application but the use of the sealing device is not intended to be limited to such apparatus.

In a further development of the present invention, the casting apparatus is modified to make moulds in which a shutter core is movable in a retaining pocket, preferably in a direction lengthwise of the mould parting line.

BRIEF DESCRIPTIONS OF THE DRAWINGS

The invention will now be further described by way of example only with reference to the accompanying drawings in which.

Figure 1:
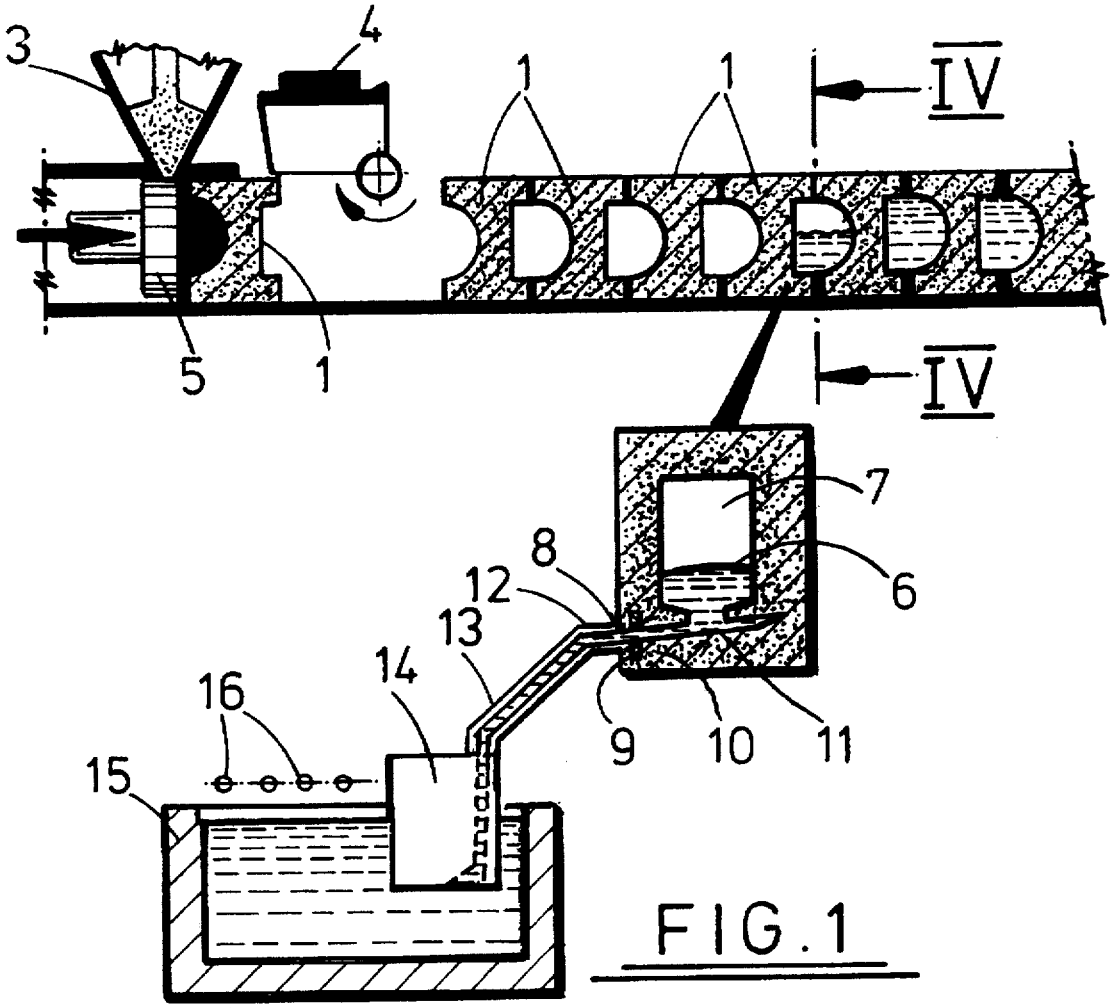
FIG. 1 is a diagrammatic side view of one embodiment of casting apparatus in accordance with the invention.
Figure 2:
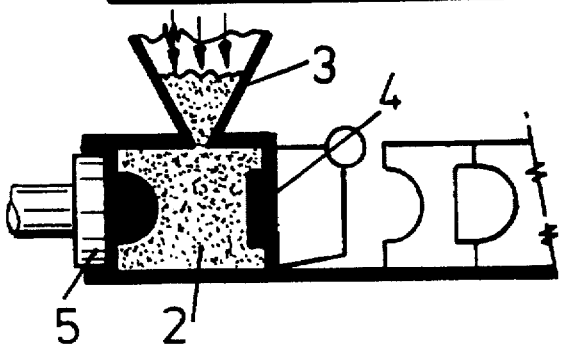
FIGS. 2 and 3 show successive preliminary stages of mould manufacture in the apparatus of FIG. 1.
Figure 8:
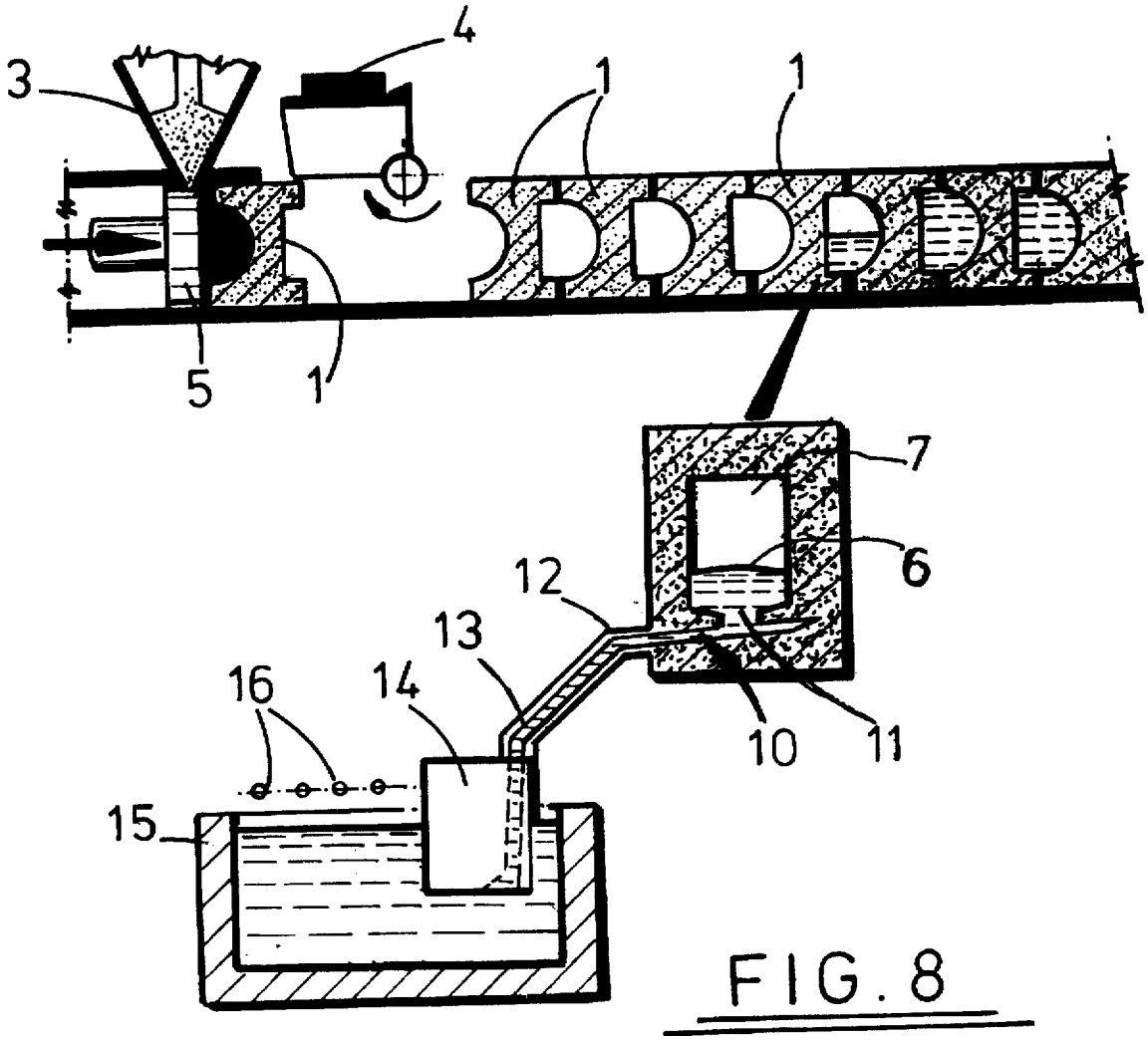
Figure 9:
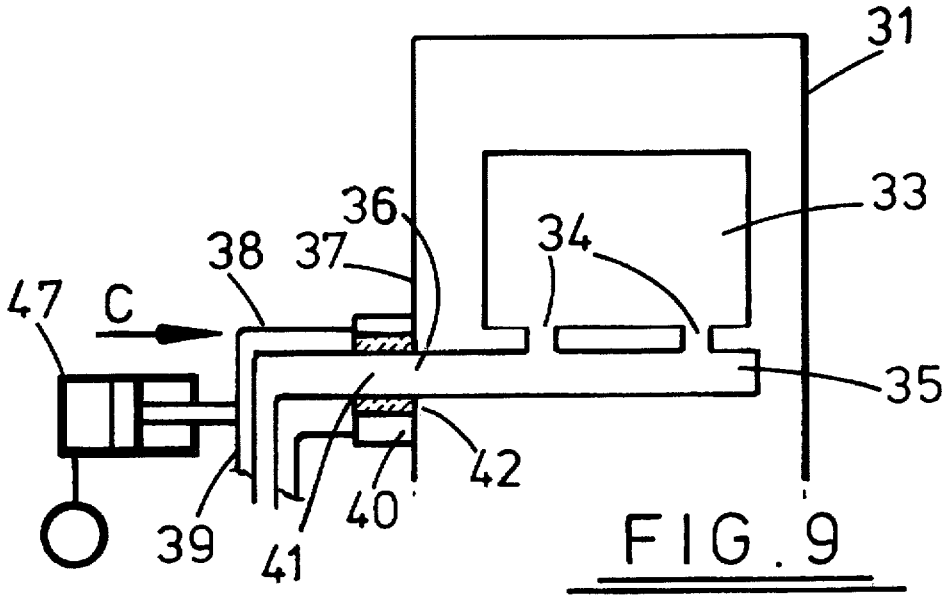
Figure 10:
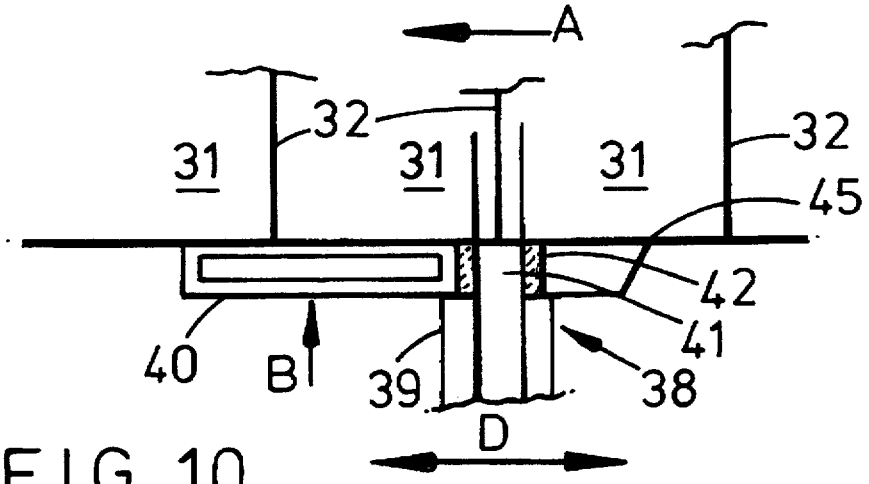
Figure 11:
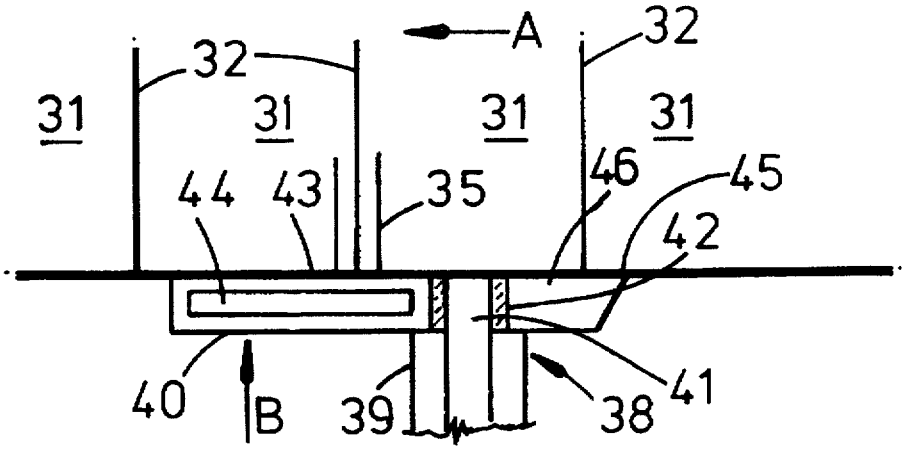
Figure 12:
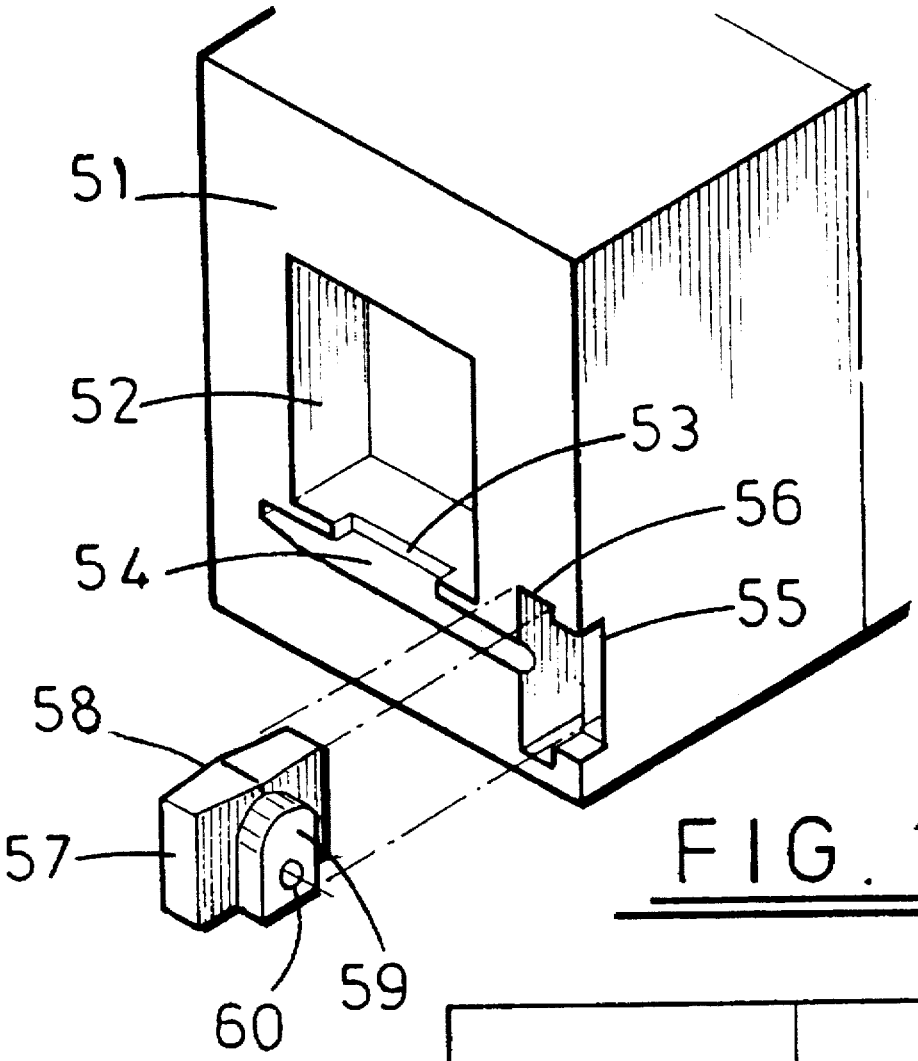
Figure 13:
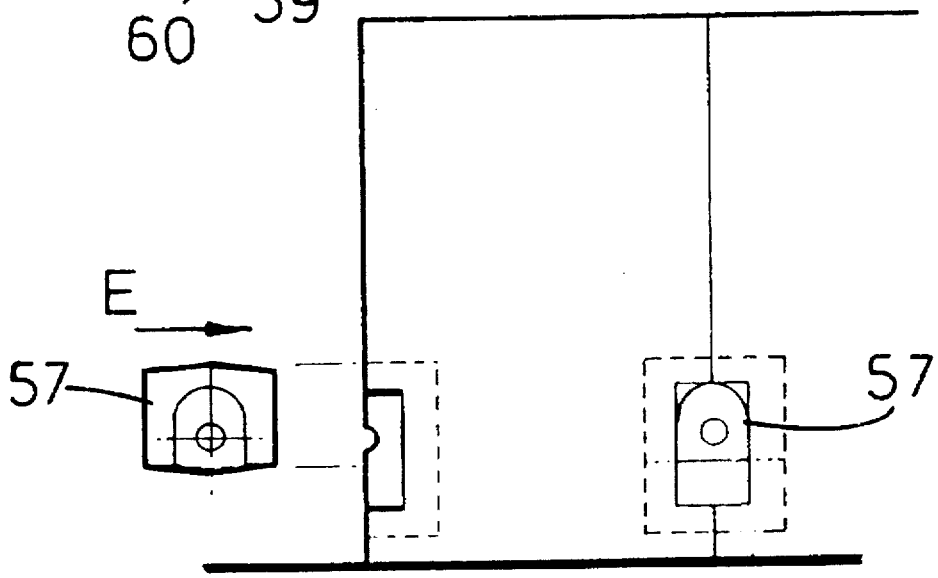
Figure 14:
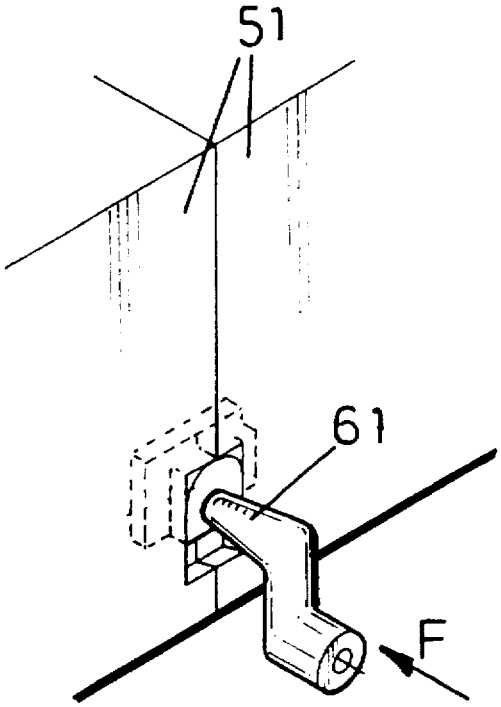
Figure 15:
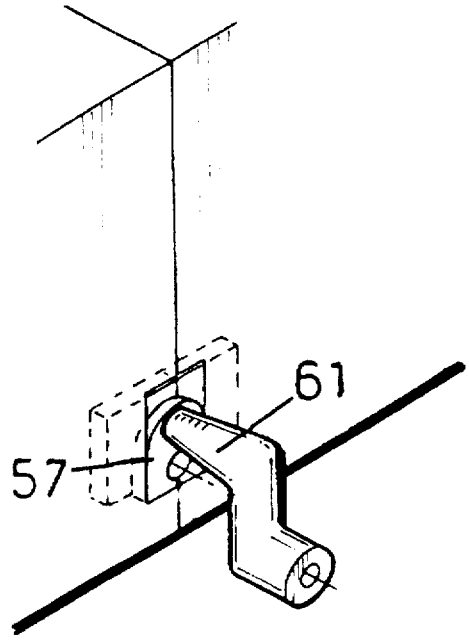
Figure 16:
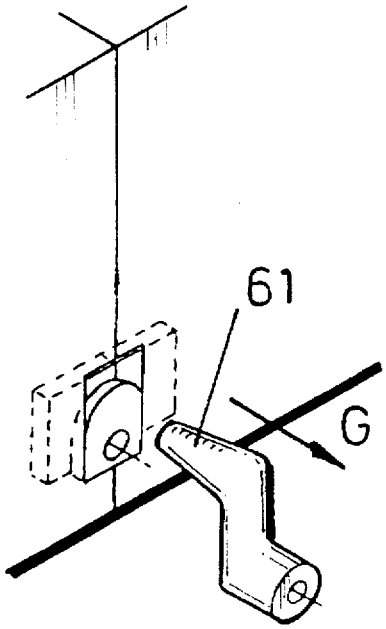

FIG. 8 corresponds to FIG. 1 with the shutter core omitted;

FIGS. 9 and 10 are vertical and horizontal sectional views respectively of one embodiment of a sealing device in accordance with the invention incorporated in casting apparatus of the invention, with the sealing device in the filling position;

FIG. 11 is a view corresponding to FIG. 10 with the sealing device in the sealing position;

FIGS. 12 and 13 are front perspective and side views respectively of moulds made by the casting apparatus of the invention showing incorporation of one embodiment of shutter core in accordance with the invention, and FIGS. 14 to 16 show successive stages in the filling operation using the shutter core.

DESCRIPTION OF THE PREFERRED EMBODIMENTS

Figure 3:
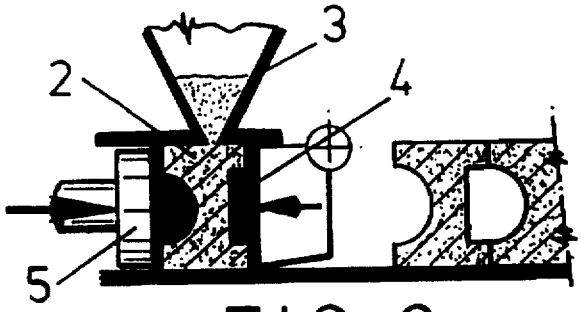

Referring now to the drawings, the illustrated apparatus comprises mould forming, assembling and filling stages. The moulds are made from green sand, i.e. sand which is bonded by a clay/water binder capable of forming an instant bond on the application of pressure. Mould halves 1 are formed in a compaction zone 2 to which green sand is supplied from a hopper 3. The exit end of the compaction zone 2 is defined by a swing plate 4 defining the profile of the front face of a half-mould. The rear profile of the half-mould is defined by a piston 5 which is advanced to compress the sand to form (FIG. 3) and then eject (FIG. 1) a fresh half-mould 1. The half-moulds 1 are then assembled in adjacent relationship such that the rear face of one half mould 1 defines the front part of a mould cavity of which the rear part is defined by the front face of the next following half mould 1.

Apparatus of the kind so far described is well known and is commercially available for example from the Danish Company Disa. In contrast to the Disa apparatus, the sand moulds of the present apparatus are bottom filled as shown diagrammatically in FIG. 1 the lower part of which shows the mould at the filling station in section on the vertical parting line. The mould is shown part filled with metal 6 the remainder of the mould cavity 7 being empty. Metal enters the mould through a bottom inlet 8, a shutter core 9, a runner 10 and a gate 11.

Figure 4:
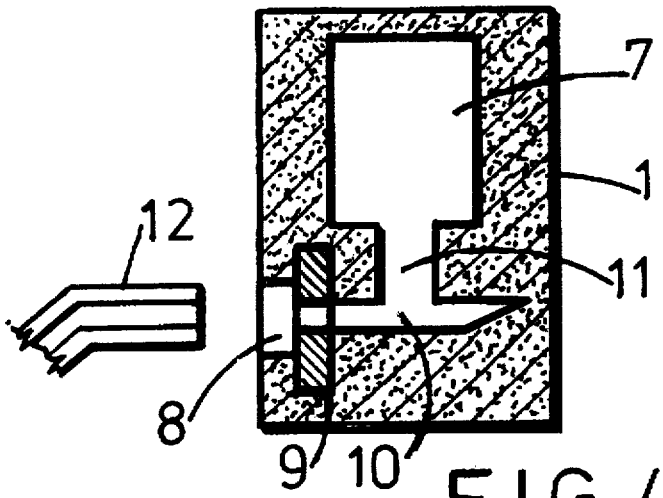
FIG. 4 is a section on line IV—IV of FIG. 1 before filling of the mould.
Figure 5:
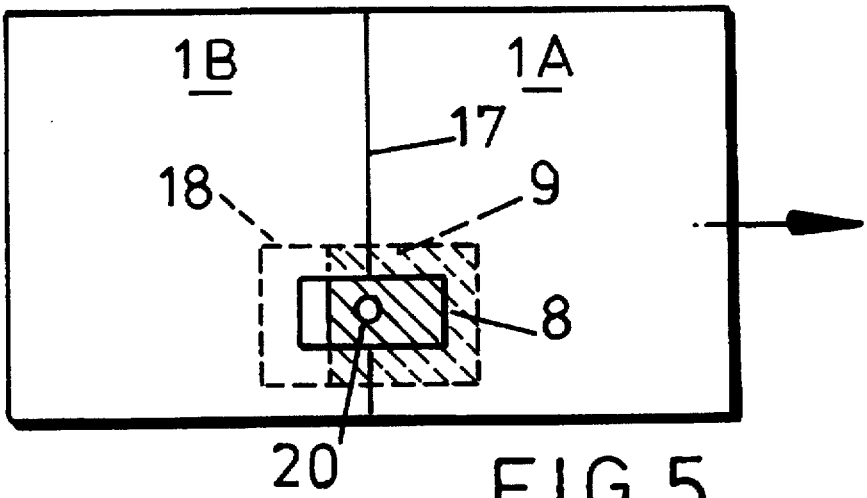
FIGS. 5 and 6 illustrate the operation of a shutter core.
Figure 6:
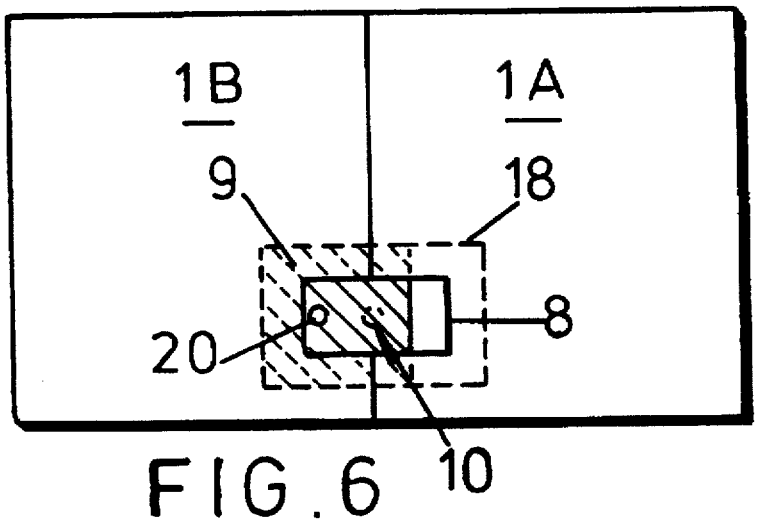

The shutter core 9 is shown in FIGS. 5 and 6. FIG. 5 is a diagrammatic side view of a mould at the filling station with leading and trailing half-moulds 1A and 1B respectively, interconnected on a vertical parting line 17. The mould inlet 8 connects with a shutter core chamber 18 in which the shutter core 9 is slidably received. The shutter core 9 has an aperture 20 which as best seen in FIG. 4 is initially in register with the runner 10 to enable the mould to be filled.

For filling the mould the inlet 8 is temporarily connected to a nozzle 12 at the upper end of a heated ceramic tube 13 connected to the output side of an electromagnetic pump 14 immersed in molten metal contained in a reservoir 15 of which the surface is exposed to the action of heaters 16. The electromagnetic pump 14 is of known kind having no moving parts and being effectively a linear motor. The level of liquid metal in the reservoir 15 is well below the level of the bottom inlet 8 of the mould at the filling station. The pump 14 therefore conveys the liquid metal upwardly against the effect of gravity to the mould inlet 8 from which the metal flows upwardly into the mould cavity 7 through the runner 10 and gate 11. The pump 14 can be controlled to vary the flow velocity and pressure of the molten metal flowing into the mould cavity 7. In this way satisfactory filling control is achieved and turbulent inflow of liquid metal into the mould cavity 7 can be avoided.

After filling, the mould is indexed forward in the direction of the arrow. Since shutter core 9 is connected to nozzle 12 during the forward indexing, the result of the indexing is that shutter core 9 is in the closed position shown in FIG. 6 in which the opening 20 therein is out of register with the runner 10. The pump nozzle 12 may then be disengaged after relieving the pumping pressure so as to lower the level of the liquid metal in the filling system to below that of the nozzle 12. As shown in FIG. 4, the pump nozzle 12 is aligned so that it is automatically in the correct location to re-engage with the shutter core of the next following mould.

In the filling system in accordance with FIG. 8 the shutter core 9 is omitted. In this case, after filling of the mould, it is necessary to provide dwell time for the metal to solidify sufficiently whereupon the pump can be deactivated or reversed so that any remaining liquid in the runner 10 is returned to the delivery system and the mould can be indexed forward. In order to minimise the cycle time attention is paid to the design of the casting and running system to ensure, as far as possible, that all heavy sections are eliminated. If heavy sections cannot be avoided metal chills may be placed into the mould or subsequently removable cooling fins may be moulded onto the heavy section to encourage cooling.

The closure system as so far described therefore involves either a short cycle time requiring a movable shutter core to be built into the mould or, alternatively, a simple mould with no moving parts but a longer cycle time. In the embodiment described with reference to FIGS. 9 to 11, the disadvantages of both closure systems described above are avoided by provision of a sealing device. A pack of moulds 31 made by the casting apparatus described above is indexable in the direction of the arrow A in FIGS. 10 and 11. As previously, the moulds have vertical parting lines 32 and each mould has a cavity 33 with bottom gates 34 connected to a horizontal or upwardly inclined runner 35 extending to a mould inlet 36 on an inlet side 37 of the mould 31. The moulds 31 are filled at a filling station by a filling head 38 comprising a pump nozzle 39 and a chill plate 40. The pump nozzle 39 is connected to a filling system as described above and its free end is fixed to the chill plate 40 in register with a filling opening 41 therein. The filling opening 41 is lined by a ceramic sleeve 42.

The chill plate 40 is of elongate rectangular shape in side elevation (i.e. in the direction of arrow B in FIGS. 10 and 11) and has a sealing face 43 which may be cooled by coolant circulating in an internal passageway 44. At its leading end, the chill plate 40 is raked or tapered to provide a cutting or chamfered edge 45 to the rear of which is a flat slide surface 46 coplanar with the sealing surface 43. If the edge 45 is a cutting edge it will cut a new sealing face in the inlet sides of the moulds during indexing of the moulds, by removal of sand to a shallow depth. If the edge 45 is chamfered a new sealing face is formed by flattening the inlet sides of the moulds during indexing, without material removal. The chill plate 40 is pressed against the inlet faces 37 of adjacent moulds 31 in the direction of arrow C in FIG. 8 by means of a pressure applicator 47 which is adjustable to vary the contact pressure between the chill plate 40 and the moulds 31.

In use of the apparatus described by reference to FIGS. 9 to 11, the filling head 38 is positioned at the filling station with lateral mobility in the directions of the double headed arrow D in FIG. 10. After indexing of the pack of moulds 31 in the direction of arrow A following a filling operation, the next mould 31 to be filled comes to rest with its parting line 32 and mould inlet 36 coincident or almost coincident with the filling opening 41 of the chill plate 40. If necessary, the filling head 38 is adjusted in the forward or rearward directions of arrow D to achieve accurate register of the inlet opening 41 of the chill plate 40 and the mould inlet 36. The filling system is then operated to introduce molten metal into the mould cavity 33 via the filling head 38, mould inlet 37, runner 35 and gates 34. Wear of the chill plate 40 by inflowing metal is reduced by the refractory sleeve 42 which by virtue of its insulating properties also prevents cooling of the metal in the filling head 38.

On completion of the mould filling operation, with the pump of the filling system maintaining sufficient pressure to prevent the metal in the mould running back, the mould pack is indexed to move on in the direction of arrow A from the filling position of FIG. 10 to the sealing position of FIG. 11. The mould runner 35 is thus automatically sealed against the chill plate 40 which will quickly freeze sufficient metal in the runner to act as a plug. Freezing of the metal occurs during sliding movement of the mould pack over the chill plate 40 between two successive filling operations and additionally during the filling time for the next following mould as seen in FIG. 10 in which the parting line 32 of the previously filled mould remains in contact with the chill plate 40. If necessary, the chill plate 40 may be extended to provide an even longer cooling time, possibly over the period of two or more filling cycles. Alternatively, additional chill plate sections may be provided downstream of the main chill plate 40.

The cutting or chamfered edge 45 at the leading end of the chill plate 40, during indexing of the mould pack, cuts or forms to a shallow depth a fresh sealing face for the pressure joint between the chill plate 40 and the inlet sides 37 of the moulds 31. This feature eliminates any problems that could otherwise arise from deformities on the inlet side of the sand mould.

The chill plate 40 is preferably made of metal, e.g. cast iron, and the coolant may be water. The sealing surface 43 may be provided with a hard-wearing ceramic coating by plasma spraying. The coating may be a refractory material, e.g. silicone nitride or boron nitride. The temperature of the coolant and/or the length of the chill plate may be varied to provide sufficient chilling to the mould inlet.

It will be appreciated that while the apparatus described with reference to FIGS. 9 to 11 is primarily intended for use in the casting apparatus of the invention for casting light metal alloys, e.g. of aluminum or magnesium, the casting apparatus is not limited to the casting of such alloys and furthermore the sealing device of the present invention may have wider application, e.g. in relation to other low pressure sand-casting processes (e.g. the Cosworth process described above).

Figure 7:
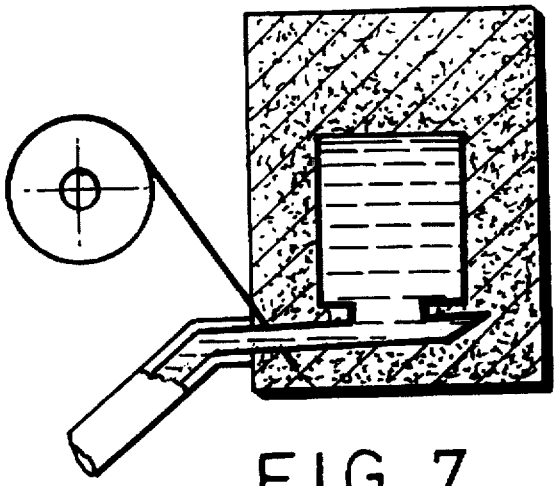
FIG. 7 shows alternative mould shutter means.

An alternative shutter design is illustrated in FIG. 7 in which a strip 22 of a suitable metal, such as aluminium alloy, fed from a coil 24 is inserted into the mould to close the inlet 8 in an appropriate manner as will be apparent to a person skilled in the art. No core making or fitting is then necessary and there is the further advantage that the cold metal shutter causes local chilling of the cast metal to effect a satisfactory seal. The leader of the metal strip is inserted and cut after each mould filling operation.

FIGS. 12 to 16 illustrate an alternative shutter design to that shown in FIGS. 4 to 6 of the first embodiment. FIG. 12 shows one half of a mould 51 with a mould cavity 52, a bottom gate 53 and a horizontal or upwardly inclined runner 54 connected to the mould inlet 55 by a pocket 56 which receives a shutter core 57 made of suitable thermal material. The pocket 56 is formed at the same time as the casting cavity 52 and the shutter core 57 remains with the mould for its full life, i.e. until the solidified casting is separated from the mould. The shutter core 57 has a main body 58 which tapers slightly to the front and rear of the mould as seen in both sides and plan view. A nose 59 projects from a side face of the body 58 and is a sliding fit in the mould inlet 55 with its front surface flush with the inlet side of the mould 51. A filling passage 60 extends from the front of the nose 59 to the rear of the body 58 and registers with the runner 54 in the filling position. FIGS. 12 and 13 show the shutter core 57 about to be inserted in the direction of arrow E into the filling position shown for the finished mould in FIG. 13. In the filling position, the shutter core 57 is located in the upper portion of its pocket 56 and held in position by friction. The lower part of the pocket 56 below the shutter core 57 provides a clearance into which the core 57 can be moved to close off the runner 54. The shutter core 57 is thus movable downwardly in the mould joint plane between the open and closed positions. This movement is carried out by any suitable means, e.g. a mechanical actuator mounted on the filling head 38. Alternatively, the arrangement may be such that the shutter core moves upwardly to its closed position or is mounted for rotation between a closed and an open position.

FIGS. 14 to 16 show one mould 51 in a pack produced by the casting apparatus described above suitably modified to incorporate the shutter core 57 into the successive moulds. The mould 51 has arrived at the filling station and a pump nozzle 61 is advanced in the direction of the arrow P into register with the inlet passage 60 of the core 57. Molten metal is delivered through the nozzle 61, core passage 60, runner 54 and gate 53 into the mould cavity 52. When the casting cavity 52 is full and while the pump of the filling system sustains pressure to keep the cavity full, the shutter core 57 is forced out of registration with the mould runner 54 and the pump nozzle 61. The hydrostatic pressure within the mould cavity now acts upon a blank portion of the rear face of the shutter core body 58 (FIG. 15) in its shut off position.

The pump pressure can now be relieved and molten metal at the nozzle 61 returned to a holding level below the level of the nozzle 61. As shown in FIG. 16, the pump nozzle 61 can now be retracted in the direction of the arrow C without any metal spillage so enabling the mould pack to index and a further cycle to be performed.

As shown in FIGS. 1 and 8 filled moulds are moved away from the filling station and the metal therein solidifies whereupon the moulds are opened to release the casting in known manner with the sand being recovered for re-use.

It will be appreciated that bottom filling of the moulds using an electromagnetic pump as described permits control of flow velocity and pressure of the melt entering the mould cavity so as to limit or prevent turbulence to the extent required for making satisfactory castings from light metal alloys for example of aluminium or magnesium. The flow velocity and pressure may also be controlled by alternative means, for example a low pressure filling system in which a low pressure gas, preferably air or nitrogen is used to displace molten metal out of a pressurised container through a riser tube. By changing the pressure and rate of delivery of the gas to the container the pressure and flow velocity can be controlled to limit turbulence of molten metal in the mould cavity.

It will be appreciated that numerous modifications may be made without departing from the scope of the invention as defined in the appended claims. For example, instead of being made of green sand the moulds may be made with a chemical binder. The moulds need not be made by the Disa process but can be made by any suitable alternative process for making individual or successive sand moulds having a vertical parting line. Alternative mould shutter mechanisms may be used. For example, the shutter core need not be apertured and can be slid from an open position into a closed position by an independent actuator. The metal strip closure may be replaced by alternative blade-like closures, for example discrete closure elements inserted into successive mould inlets by a suitable mechanism.

We claim:

1. A method of casting light alloy metal products, comprising the steps of:

introducing molten light alloy metal into a series of continuously produced contiguous sand moulds, each sand mould having a vertical parting line, an inlet and a cavity, by bottom filling the mould inlets and cavities sequentially in a manner permitting control of flow velocity and pressure, and advancing the moulds in unison after each introducing step and before complete solidification of the metal introduced into a mould inlet in that introducing step.

2. The method of claim 1, wherein the mould is a green sand mould.

3. The method of claim 2, wherein said series of continuously produced contiguous sand moulds is produced by a process comprising forming identical half-moulds, each half mould having a front face defining a rear part of a mould cavity of one mould and a rear face defining a front part of a mould cavity of a next following mould.

4. The method of claim 1, further comprising the step of:

conveying the molten metal for introduction into the mould inlet and cavity being filled from a reservoir below the mould.

5. The method of claim 4, wherein the molten metal is conveyed by a pump.

6. The method of claim 5, wherein the pump is an electromagnetic pump.

7. The method of claim 1, wherein the metal is selected from the group consisting of an aluminium alloy and a magnesium alloy.

8. A casting apparatus comprising means for producing a series of contiguous sand moulds, each sand mould having a vertical parting line, a cavity and an inlet;

means for bottom filling the mould inlets and cavities sequentially with molten metal in a manner permitting control of flow velocity and pressure; and means for advancing the moulds in unison after each filling operation and before complete solidification of the metal introduced into a mould inlet in that operation.

9. The casting apparatus of claim 8, wherein the mould producing means is adapted to produce the series of moulds by a process comprising forming identical half-moulds, each half-mould having a front face defining a rear part of a mould cavity of one mould and a rear face defining a front part of a mould cavity of a next following mould.

10. The casting apparatus of claim 8, wherein the filling means includes a reservoir for molten metal disposed below the mould.

11. The casting apparatus of claim 10, wherein the filling means further includes a pump for pumping molten metal from the reservoir to the mould.

12. The casting apparatus of claim 11, wherein the pump is an electromagnetic pump.

13. The casting apparatus of claim 8 further including a sealing device, said sealing device comprising a chill plate, said chill plate having a sealing face and a filling opening, the chill plate adapted for sliding contact of the sealing face with an inlet side of a sand mould moving between a filling position in which the filling opening registers with a mould inlet and a sealing position in which the mould inlet is closed by the sealing face.

14. The casting apparatus of claim 8, wherein the mould further includes a retaining pocket and the apparatus further includes a shutter core, said shutter core including:

a main body of a thermal material with a filling passage extending therethrough, wherein the shutter core is positioned within the retaining pocket and adapted such that the shutter core is moveable in the retaining pocket between a position wherein the shutter core filling passage registers with the mould inlet and a position wherein the shutter core main body closes the inlet.

15. The casting apparatus of claim 13, wherein the chill plate filling opening has an insulating refractory lining.

16. The casting apparatus of claim 13, wherein the chill plate is adapted for internal circulation of coolant to lower the temperature of the sealing face.

17. The casting apparatus of claim 13, wherein the chill plate is fixed to a filling nozzle for introducing molten metal into the mould.

18. The casting apparatus of claim 13, wherein means is provided for pressing the chill plate against the inlet side of the mould at an adjustable pressure.

19. The casting apparatus of claim 13, wherein the leading end of the chill plate has a cutting edge for making a smooth contact face in the inlet side of the mould during said sliding movement.

20. The casting apparatus of claim 13, wherein the leading end of the chill plate has a chamfer edge for making a smooth contact face in the inlet side of the mould during said sliding movement.

* * * * *